United States Patent [19]

Schreiber et al.

[11] Patent Number: 4,772,054

[45] Date of Patent: Sep. 20, 1988

[54] DOOR HOLDER FOR MOTOR VEHICLE DOORS

[75] Inventors: Winfried Schreiber, Stuttgart; Klaus Claar, Sindelfingen, both of Fed. Rep. of Germany

[73] Assignee: Daimler-Benz Aktiengesellschaft, Stuttgart, Fed. Rep. of Germany

[21] Appl. No.: 131,501

[22] Filed: Dec. 11, 1987

[30] Foreign Application Priority Data

Dec. 20, 1986 [DE] Fed. Rep. of Germany ..... 3643777

[51] Int. Cl.[4] ..... E05C 17/20

[52] U.S. Cl. ..... 292/275; 16/86 C; 292/252

[58] Field of Search ..... 292/275, 252, 262, DIG. 38, 292/147; 16/86 C

[56] References Cited

U.S. PATENT DOCUMENTS

| | | | |
|---|---|---|---|
| 2,043,976 | 6/1936 | Schonitzer | 292/275 X |
| 2,268,942 | 1/1942 | Jacobs | 292/275 X |
| 2,832,623 | 4/1958 | Golemon | 292/252 |

*Primary Examiner*—Richard E. Moore

*Attorney, Agent, or Firm*—Barnes & Thornburg

[57] ABSTRACT

A door holder for motor vehicle doors includes a housing with guide tracks and detent recesses as well as a guide body secured at a holding strap whose balls mounted in a bushing and acted upon by a compression spring by way of intermediate plates engage in the detent recesses, whereby the bushing surrounds the balls beyond half of their height, and in which the bushing includes at half of its length within its bore a support part for the compression spring, and the guide tracks are extended beyond the detent recesses up to an end abutment.

4 Claims, 1 Drawing Sheet

DOOR HOLDER FOR MOTOR VEHICLE DOORS

BACKGROUND AND SUMMARY OF THE INVENTION

The present invention relates to a door holder for motor vehicle doors with a C-shaped housing within which a guide body secured at a band-like strap that is pivotally supported on the side of the body, glides along the side walls of the housing.

A door holder for motor vehicle doors is disclosed in the DE-OS No. 26 44 570 in which the guide tracks of the balls terminate with the detent recesses in front of the end abutment which is formed by an uprighted end-side edge of the C-shaped housing, and in which a bushing of a guide body accommodates two balls which are acted upon by a compression spring disposed therebetween directly abutting at the balls and in dependence of one another.

Such a construction of the door holder does not endanger the function thereof but leads to several disagreeable accompanying phenomena such as a clicking noise while the balls overcome the raised portion behind the detent recesses up to reaching the movement limit by means of the end abutment. A jamming of the balls and a jerking movement of the vehicle door effected thereby may also occur when leaving the detent recesses if the bushing accommodates only one-half of each ball, and the engaging driving force of the bushing is too small owing to this slight guide influence in order to bring the balls into rolling.

If the balls are placed directly against the compression spring, then it is possible that the static friction between these parts is greater than the roll resistance between the balls and their guide tracks so that the balls can only be still moved slidingly on the same which leads to a movement of the vehicle door involving a greater force with a creaking noise accompanying the same.

It is the principal object of the present invention to enable a more comfortable movement progress of the door.

The underlying problems are solved according to the present invention in that an intermediate plate displaceable in the bushing perpendicularly to the direction of the guide tracks abuts at the compression spring on each side thereof pointing toward one of the balls, in that the ball slides on the intermediate plate, in that the bushing includes a support part at about half of its length which protrudes into its bore, is positionally stable and serves for the support of the compression spring, in that the bushing surrounds the balls in detent position over half the height thereof and in that the guide tracks are extended beyond the detent recesses located in front of an end abutment up to this end abutment.

Owing to these measures, a rolling-off along the guide tracks and a sliding on the intermediate plate is made possible to the balls during the entire movement along the guide tracks so that the movement of the vehicle door can take place without additional force application and without disturbing accompanying noises.

The abutment of the balls at their guide tracks is stabilized equally on both sides by the support part in the bushing so that they always engag in their detent recesses at the same time and are again moved out of the same at the same time, even if the guide body cannot maintain on both sides the same distance with respect to the housing sides owing to a tolerance-conditioned height displacement of the vehicle body-joint with respect to the housing.

BRIEF DESCRIPTION OF THE DRAWINGS

These and other objects, features and advantages of the present invention will become more apparent from the following description when taken in connection with the accompanying drawing which shows, for purposes of illustration only, several embodiments in accordance with the present invention, and wherein.

DETAILED DESCRIPTION OF THE DRAWINGS

Figure 1:
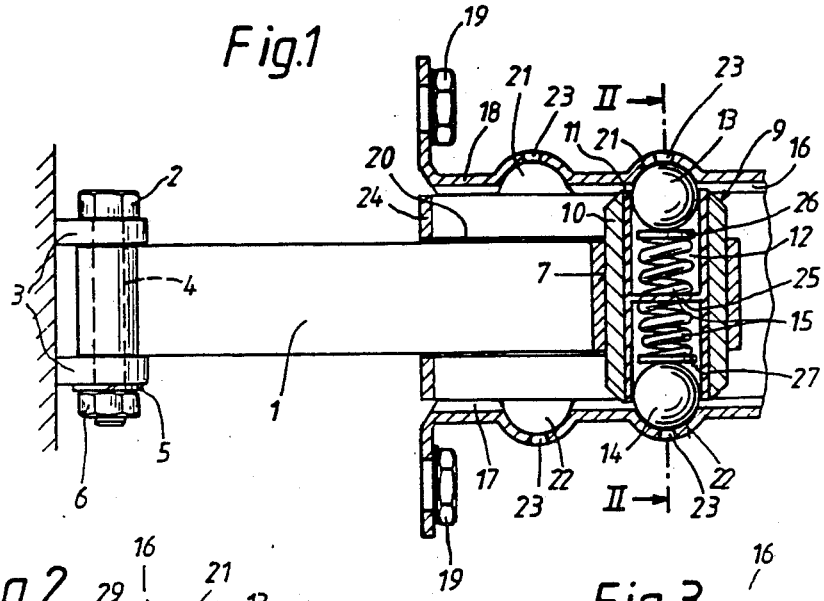
FIG. 1 is a side elevational view, partly in cross section, of a door holder in accordance with the present invention in the installed position.

Referring now to the drawing wherein like reference numerals are used throughout the various views to designate like parts, FIG. 1 illustrates a door holder for motor vehicle doors which includes a band-like holding strap 1 that is pivotally supported at the vehicle body in that a threaded bolt 2 extends through lugs 3 of the vehicle body and a bore 4 of the holding strap 1 and is retained by a clamping ring 5 and a nut 6.

At the opposite end of the holding strap 1, the latter receives within a mounting bore 7 a guide body which is secured in the mounting bore 7 by means of a bushing generally designated by reference numeral 9 that consists of two nested tubular pieces 10 and 11 disposed one within the other.

Two balls 13 and 14 are located in the two end openings of the bushing bore 12 which are pressed by a compression spring 15 disposed therebetween in the direction toward two oppositely disposed guide tracks 16 and 17 of a C-shaped housing 18 of the door holder which is secured inside of a cut-out in the vehicle door by way of threaded connections, of which only nuts 19 welded to the housing 18 are illustrated herein, and which includes along the sides extending perpendicularly to the guide track 16 and 17 longitudinal slots 20 parallel to these sides for the free passage of the holding strap 1.

The guide tracks 16 and 17 include oppositely disposed detent recesses 21 and 22 into which the balls 13 and 14 engage at the same time as soon as the motor vehicle door has been brought into the corresponding position.

In order that no dirt collects in the detent recesses 21 and 22 which would impair their function, openings 23 are provided at their apices through which the dirt falls out.

The guide tracks 16 and 17 are extended up to the end abutment 24 formed by the housing 18 beyond the detent recesses 21 and 22 which are located in front of the end abutment 24 in order that the balls 13 and 14 and the bushing 9 can really move without additional force expenditure up to the end abutment where their movement is then finally limited.

The compression spring 15 which is constructed in FIG. 1 two-partite, is supported inside of the bushing bore 12 at half the bushing length by a support part 25 which is formed-on at the inner tubular member 11, in order that the balls 13 and 14 are pressed against their guide tracks 16 and 17 independently of one another.

An intermediate plate 26 and 27 is inserted in the transition from the compression spring 15 to the balls 13 and 14; the intermediate plates 26 and 27 are preferably provided with a surface coated with plastic material as contrasted to the balls 13 and 14 made from steel, as a result of which the static friction between these parts can be kept very small, and the balls 13 and 14 thereby slide on their intermediate plates 26 and 27 and roll off uniformly on their guide tracks 16 and 17.

Figure 2:
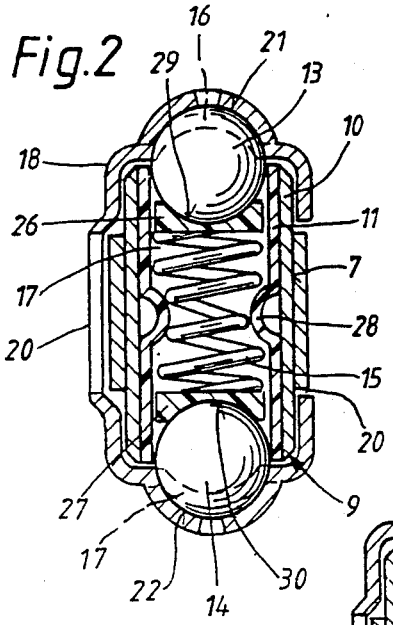
FIGS. 2, 3 and 4 are cross-sectional views taken along line II—II of FIG. 1 and illustrating further modified embodiments of a guide body within a housing of a door holder in accordance with the present invention.

In FIG. 2, the inner tubular member 11 is provided at half of its length with a circumferential groove 28 protruding into a bushing bore 12, at the height of which a compression spring 15 has a smaller diameter whereas the spring 15 is widened on both sides of the groove 28 and, as a result thereof, is supported thereon, and acts upon the balls 13 and 14 independently of one another.

Figure 3:
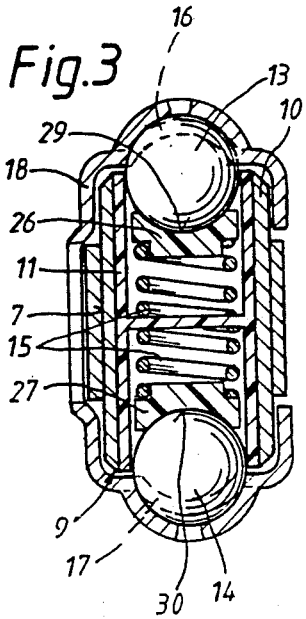

In FIGS. 2 and 3, the intermediate plates 26 and 27 are additionally provided in their surfaces pointing toward the balls 13 and 14 with sockets 29 having a radius corresponding to that of the balls 13 and 14 whereby the force introduction of the compression spring 15 into the balls 13 and 14 is improved so that the balls are pressed uniformly against their guide tracks 16 and 17.

Figure 4:
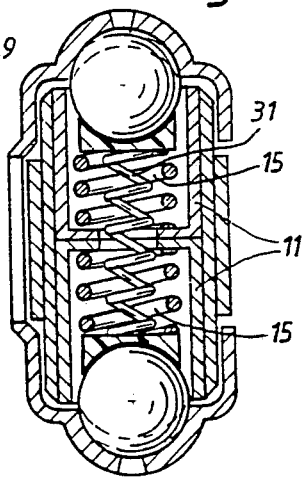

FIG. 4 illustrates a further embodiment of the guide body in which by the use of a further compression spring 31 which is combined in a space-saving manner with the first spring, the overall spring characteristics can be optimized, and in which the tubular member 11 is constructed two-partite in a manner more favorable from a manufacturing point of view, and is provided each with a bored bottom constructed as support part 25.

While we have shown and described several embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A door holder for motor vehicle doors, comprising housing means of substantially C-shaped cross section, holding strap means pivotally supported on the side of the body, guide body means in said housing means and secured at said strap means, said guide body means sliding along the side walls of said C-shaped housing means and springily cooperating with substantially semi-circularly shaped guide track means formed-in into mutually opposite side walls of the housing means, said guide body means including bushing means and balls, said guide track means being provided with mutually oppositely disposed, outwardly pressed detent recesses for the detent engagement of said balls, the balls being rotatably mounted in the two end openings of the bushing means directed toward the respective guide track means, compression spring means arranged between and acting upon the balls in the direction toward the respective guide track means, intermediate plate means displaceable in the bushing means substantially perpendicularly to the associated guide track means abutting at the compression spring means on each side thereof pointing toward a respective one of the balls, the balls being operable to slide on the intermediate plate means, the bushing means including at about half of the length thereof a support part serving for the support of the compression spring means, said part protruding into the bore of the bushing means and being positionally stable, the bushing means surrounding the balls in the engaged position over half the height thereof, and the guide track means being extended beyond the detent recesses located in front of an end abutment up to the end abutment.

2. A door holder according to claim 1, wherein the support part is formed by a circumferential groove in the bushing walls and the compression spring means is widened in diameter on both sides of the groove with respect to the width of the spring portion passing through the groove.

3. A door holder according to claim 1, wherein a socket means having a radius corresponding substantially to that of the ball is formed-in centrally into the intermediate plate means on its side facing a respective ball.

4. A door holder according to claim 1, wherein a further compression spring means is arranged in the bushing bore inside the first-mentioned compression spring means, which also acts in the direction toward the balls.

* * * * *